US009452622B2

(12) United States Patent
Chover López et al.

(10) Patent No.: US 9,452,622 B2
(45) **Date of Patent: *Sep. 27, 2016**

(54) INTERCHANGEABLE PRINTER PLATENS

(71) Applicant: Hewlett-Packard Development Company, L.P., Houston, TX (US)

(72) Inventors: Carlos Chover López, Barcelona (ES); Lluis Hierro Domenech, Sant Llorenc d'Hortons (ES); Emilio Angulo Navarro, Barcelona (ES); Francisco Javier Pérez Gellida, Barcelona (ES)

(73) Assignee: HEWLETT-PACKARD DEVELOPMENT COMPNY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/826,024

(22) Filed: Aug. 13, 2015

(65) Prior Publication Data

US 2015/0343806 A1 Dec. 3, 2015

Related U.S. Application Data

(63) Continuation of application No. 13/718,747, filed on Dec. 18, 2012, now Pat. No. 9,145,002.

(51) Int. Cl.

| | |
|---|---|
| ***B41J 11/04*** | (2006.01) |
| ***B41J 3/407*** | (2006.01) |
| ***B41J 11/00*** | (2006.01) |
| ***B41J 11/06*** | (2006.01) |

(52) U.S. Cl.
CPC ..... *B41J 11/04* (2013.01); *B41J 3/407* (2013.01); *B41J 3/4078* (2013.01); *B41J 11/0085* (2013.01); *B41J 11/06* (2013.01)

(58) Field of Classification Search
CPC ..... B41J 11/02; B41J 11/06; B41J 11/0085; B41J 3/28; B41J 11/08; B41J 11/14
USPC ..... 347/104, 4, 16
See application file for complete search history.

(56) References Cited

U.S. PATENT DOCUMENTS

| | | | | |
|---|---|---|---|---|
| 5,838,338 | A | 11/1998 | Olson | |
| 6,000,786 | A | 12/1999 | Larson | |
| 6,361,230 | B1 | 3/2002 | Crystal et al. | |
| 6,594,027 | B1 | 7/2003 | Guillemin et al. | |
| 8,721,037 | B2 * | 5/2014 | Sutton | B41J 11/0065 347/31 |
| 9,145,002 | B2 * | 9/2015 | Chover Lopez | B41J 3/407 |
| 2009/0284575 | A1 * | 11/2009 | Verhoest | B41J 11/001 347/104 |
| 2012/0069115 | A1 * | 3/2012 | Asada | B41J 13/14 347/104 |
| 2013/0293652 | A1 | 11/2013 | Spence et al. | |
| 2013/0334757 | A1 * | 12/2013 | Gerber | B41J 13/14 269/289 R |

* cited by examiner

*Primary Examiner* — Henok Legesse
(74) *Attorney, Agent, or Firm* — HP Inc.—Patent Department

(57) ABSTRACT

In one example, a platen system for a printer includes a group of interchangeable platens each configured to support a different type of print substrate in the printer.

15 Claims, 11 Drawing Sheets

INTERCHANGEABLE PRINTER PLATENS

PRIORITY

This application is a Continuation of commonly assigned and co-pending U.S. patent application Ser. No. 13/718,747, filed Dec. 18, 2012, the disclosure of which is hereby incorporated by reference in its entirety.

BACKGROUND

Many wide format inkjet printers utilize an elongated platen to support the print substrate through the print zone. It is often desirable to use platen configurations specially configured to support a variety of different types of print substrates. For example, a platen that includes an ink absorber may be desirable for printing on textiles and other porous substrates while a smooth hard vacuum platen may be desirable for printing on vinyl substrates.

DRAWINGS

FIGS. 1-3 illustrate an inkjet printer implementing one example of a new platen system for supporting different types of print substrates. In the example shown in FIGS. 1-3, the platen assembly in the printer includes a fixed platen and a removable, interchangeable platen.

FIGS. 4-6, 7, and 8, respectively, illustrate each of three interchangeable platens for the platen assembly in the printer of FIG. 1.

The same part numbers designate the same or similar parts throughout the figures.

DESCRIPTION

A new platen system has been developed to increase the versatility of wide format inkjet printers for printing on different types of substrates. Inkjet printers using latex inks are capable of printing on a variety of very different substrates including, for example, paper, textiles, and vinyl. These types of print substrates each have unique characteristics. Accordingly, it is often desirable to specially configure the platen to a particular type of print substrate to better support or control the substrate through the print zone. Specially configured platens are particularly desirable for wide format printers, which may handle print substrates as wide as several meters. Currently, however, it is difficult to use the same wide format printer to print on disparate substrates, like paper, textiles and vinyl for example, because significant modifications may be made to the printer platen to achieve consistently good print quality.

The new platen system includes interchangeable platens to support different types of print substrates. For example, a platen system for a wide format latex inkjet printer might include a group of three interchangeable platens specially configured for paper, textile and vinyl so that the printer can be readily adapted for printing on any of these three types of print substrate by replacing one platen with another platen. Also, in one example implementation, each platen in the group consists of multiple modules to more easily vary the width of the platen to accommodate different size print substrates and/or different size printers by simply using more or fewer modules. In another example implementation, the new platen system utilizes a divided platen in which one part of the platen is fixed in the printer and the other part is an interchangeable platen that is easily removed and replaced by another one of the interchangeable platens.

Examples of the new platen system are described below with reference to a wide format, scanning printhead type inkjet printer. The new platen system, however, is not limited to such inkjet printers or even to inkjet printing, but may be implemented in other printers. Accordingly, the examples shown in the figures and described below illustrate but do not limit the invention, which is defined in the Claims following this Description.

Figure 1:
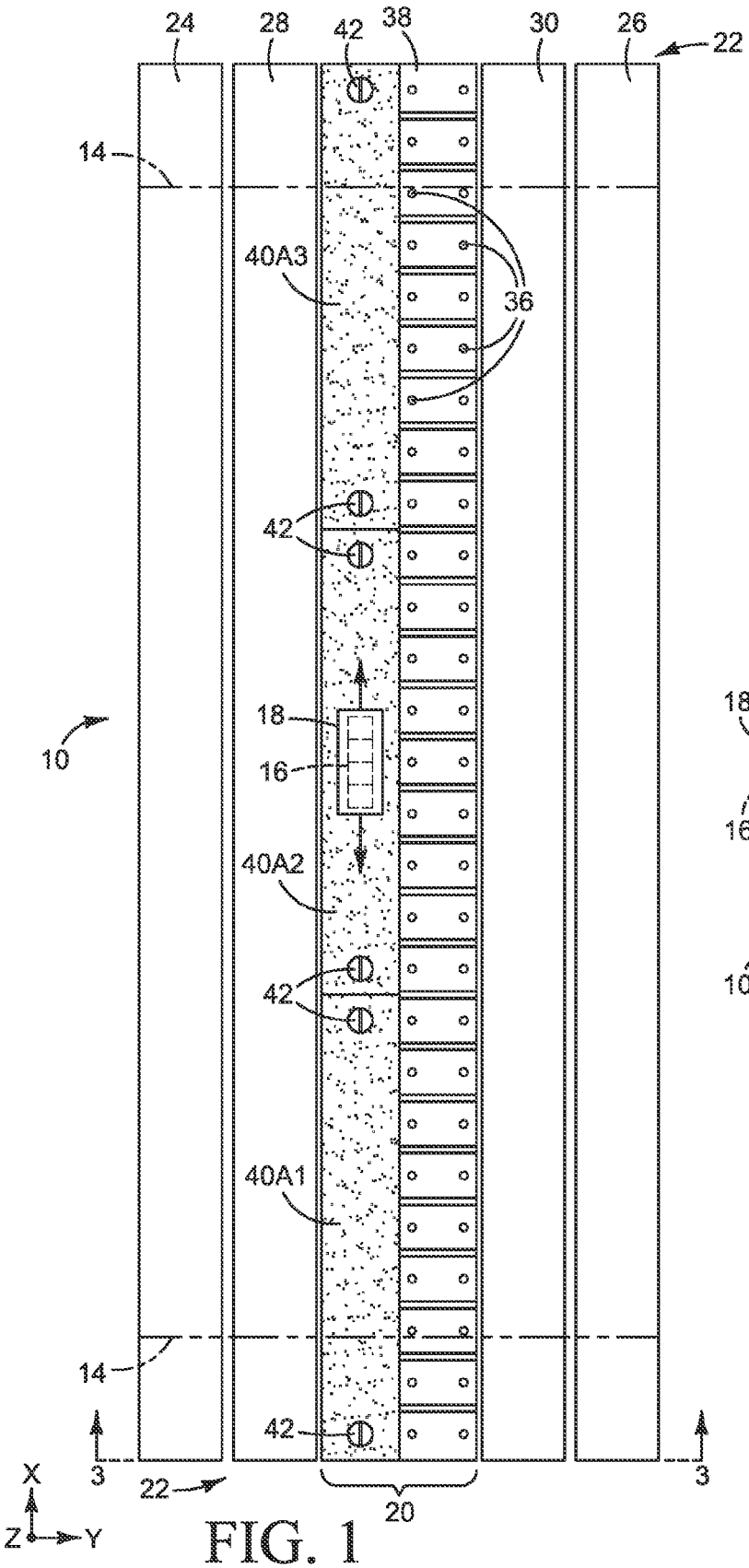
Figure 2:
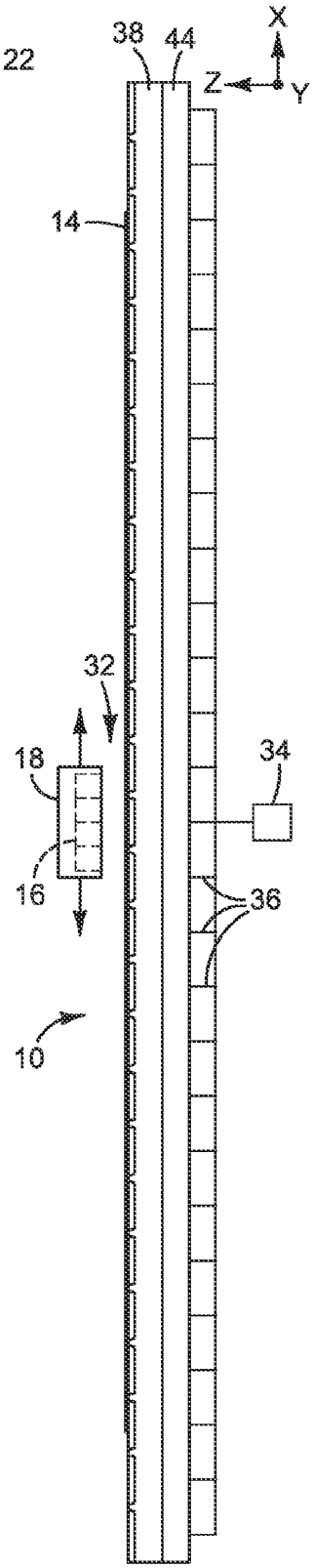
Figure 3:
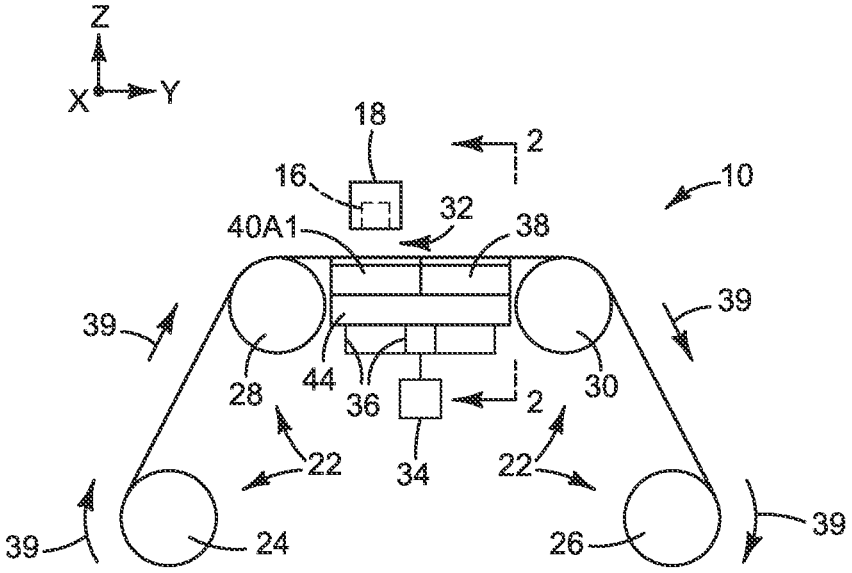
Figure 4:
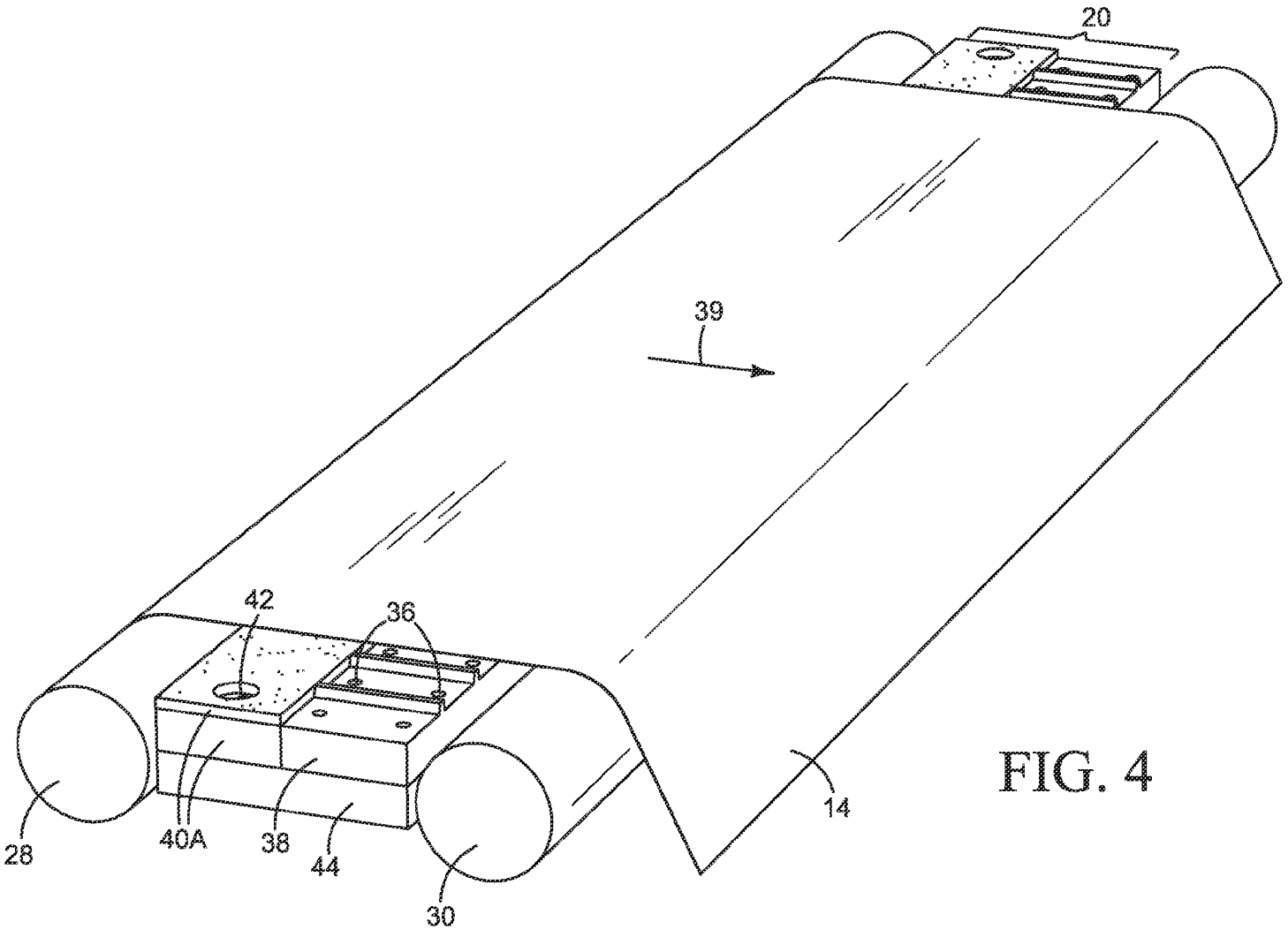
Figure 5:
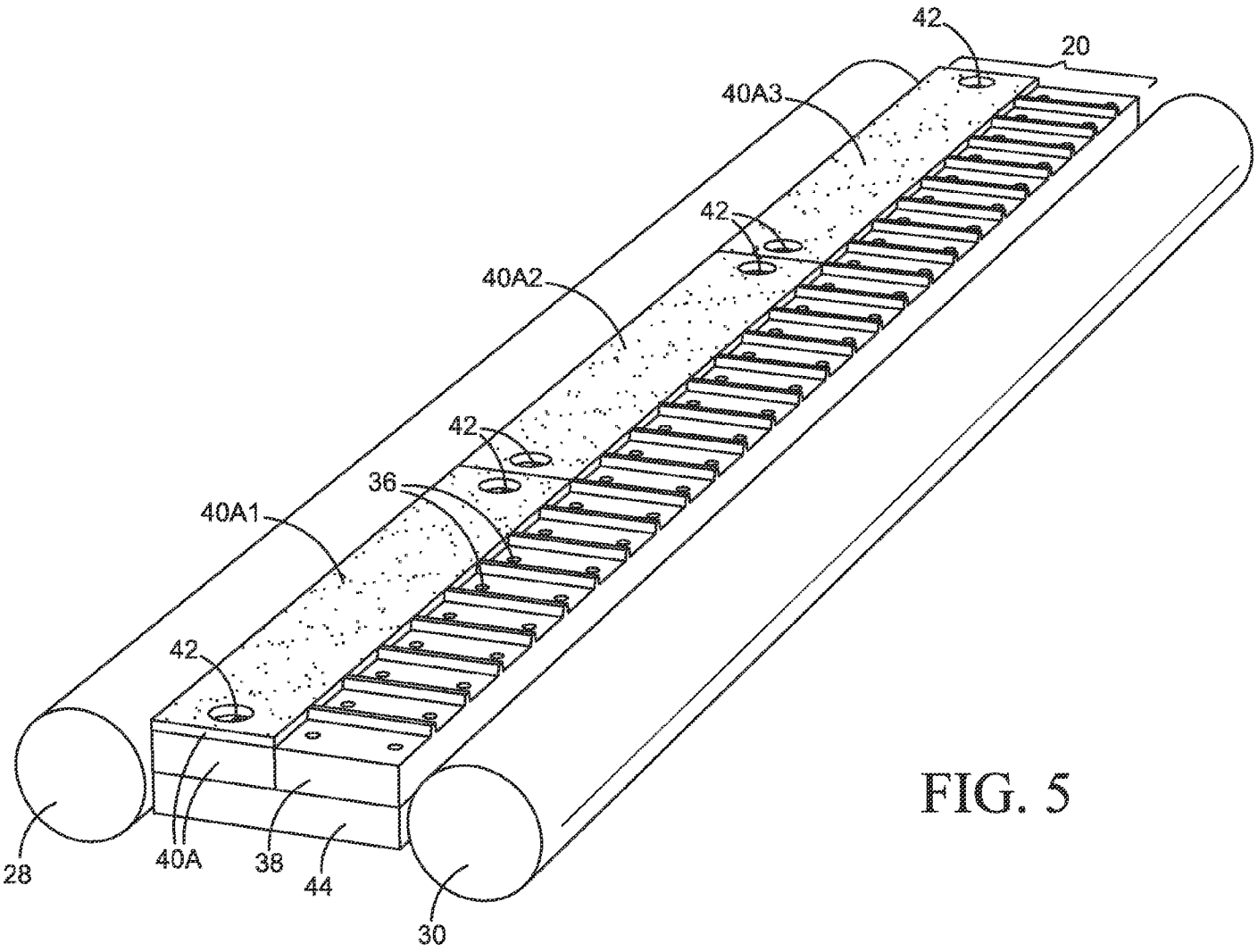
Figure 6:
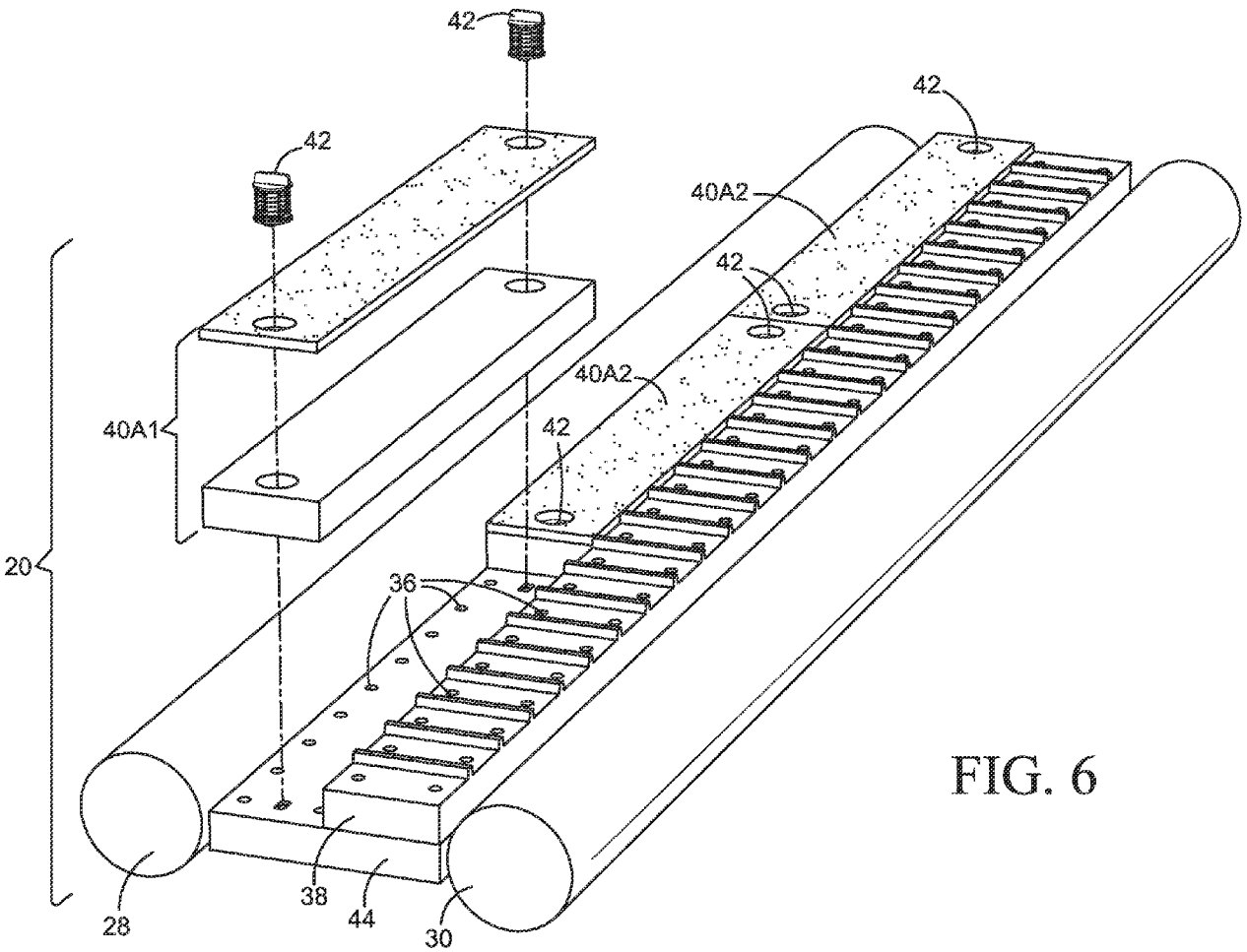

FIGS. 1-3 illustrate an inkjet printer 10 implementing one example of a new platen system 12 (FIG. 9) for supporting different types of print substrates 14. Each of three interchangeable platens for platen system 12 are shown individually in FIGS. 4-6, 7, and 8, and together as a group in FIG. 9. Referring first to FIGS. 1-3, printer 10 includes a group of multiple printheads 16, for example to dispense different color inks, mounted on a carriage 18 over a platen assembly 20. A substrate transport 22 in printer 10 includes a web supply roller 24 and a web take-up roller 26. A web print substrate 14 extends from supply roller 24 over platen assembly 20 and intermediate rollers 28, 30 to take-up roller 26. Intermediate rollers 28, 30 may be used, for example, to help control the direction and tension of web 14 through a print zone 32 over platen 20. (Only the outline of print substrate 14 is shown in FIG. 1, to not obscure that part of platen 20 beneath substrate 14.) Printheads 16 dispense ink as they are scanned back and forth on carriage 18 across substrate 14 as it passes over platen assembly 20 through print zone 32. An air pump or other suitable vacuum source 34 operatively coupled to platen assembly 20 through a system of air passages 36 and controls (not shown) may be used to exert a hold-down force on print substrate 14 as necessary or desirable for some printing operations.

In the example shown, platen assembly 20 includes a first, fixed platen 38 and a second, removable platen 40. As used in this document, "fixed" means not easily removed and "removable" means easily installed and removed. Removable platen 40 in FIGS. 1-3 represents multiple interchangeable platens each easily installed into and removed from printer 10, for example using quick release fasteners 42. Fixed platen 38, by contrast, is a fixed part of printer 10. Thus, while it may be possible to remove platen 38 for maintenance, repair or replacement, platen 38 represents generally a fixed part of printer 10 that is not designed to be removed or replaced regularly like interchangeable platen 40. Also, in the example shown, interchangeable platen 40 is positioned directly under printheads 16 and fixed platen 38 is positioned downstream from interchangeable platen 40. The use of a fixed platen 38 may help minimize the area needed for, and thus the size of, interchangeable platen 40. With a fixed platen 38, interchangeable platen 40 may be constrained more closely to the area directly under printheads 16 where ink is dispensed on to substrate 14. If a fixed platen 38 is used, it may be positioned downstream from interchangeable platen 40, as shown, or at other suitable locations upstream from platen 40 or on both sides of platen 40.

"Upstream" and "downstream" refer to the direction substrate 14 moves through print zone 32. The direction print substrate 14 moves through print zone 32 is indicated by arrows 39 in the figures. "Length" is along the Y direction, the direction substrate 14 moves through print zone 32. "Width" is across in the X direction, perpendicular to the direction substrate 14 moves through print zone 32. Thus, in the examples shown in the figures, platen assembly 20 is much wider than it is long.

Figure 7:
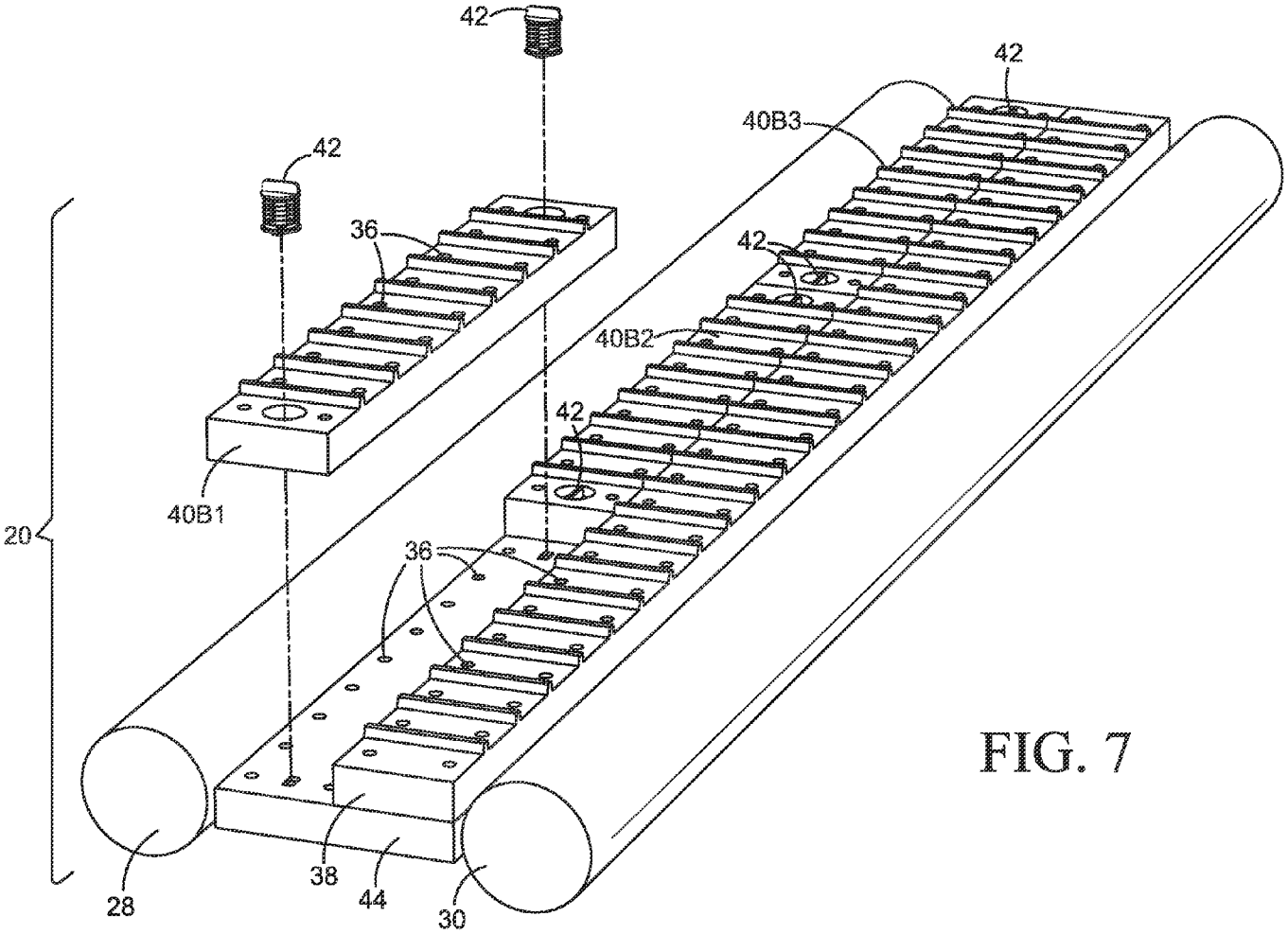
Figure 8:
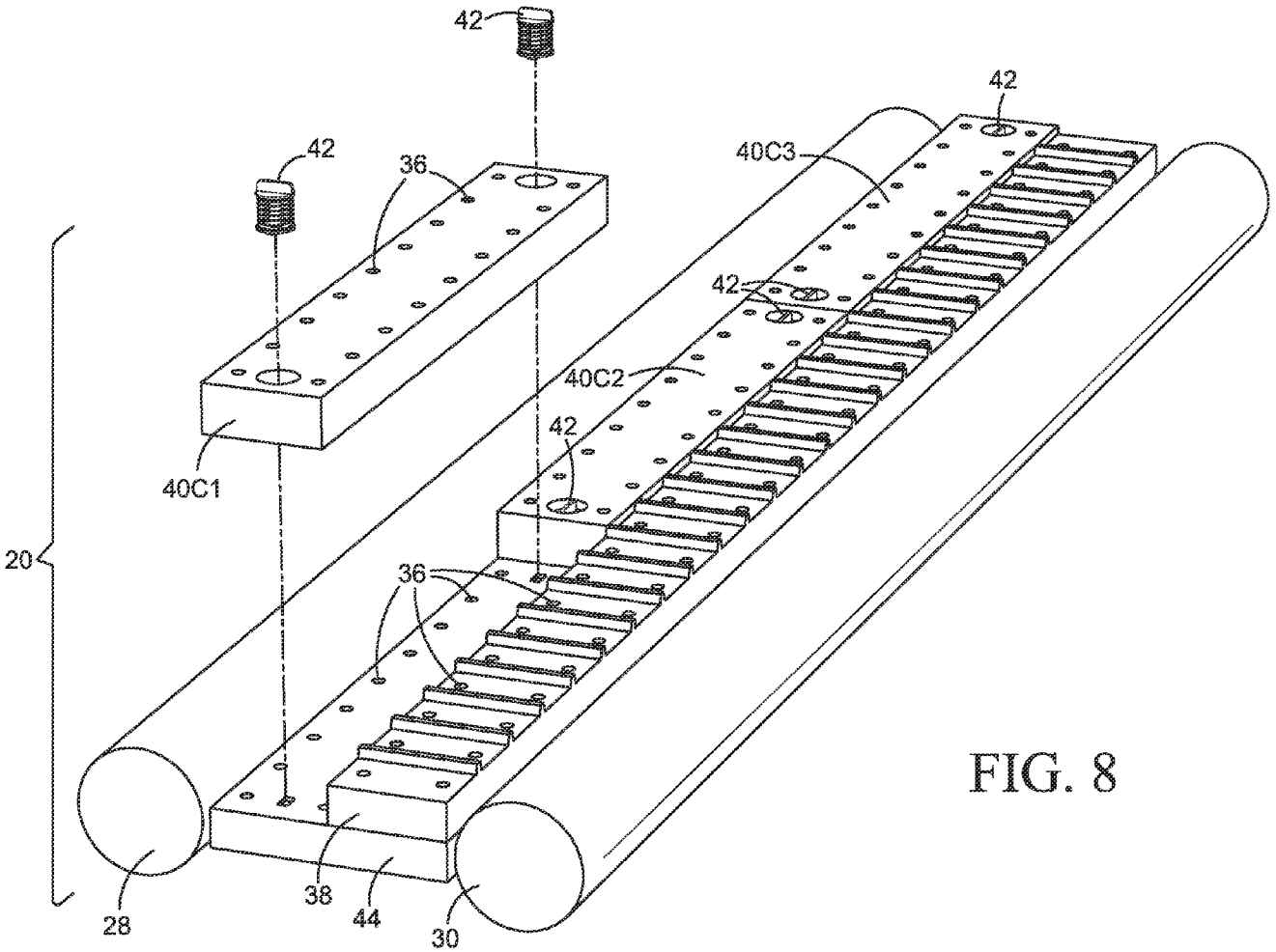
Figure 9:
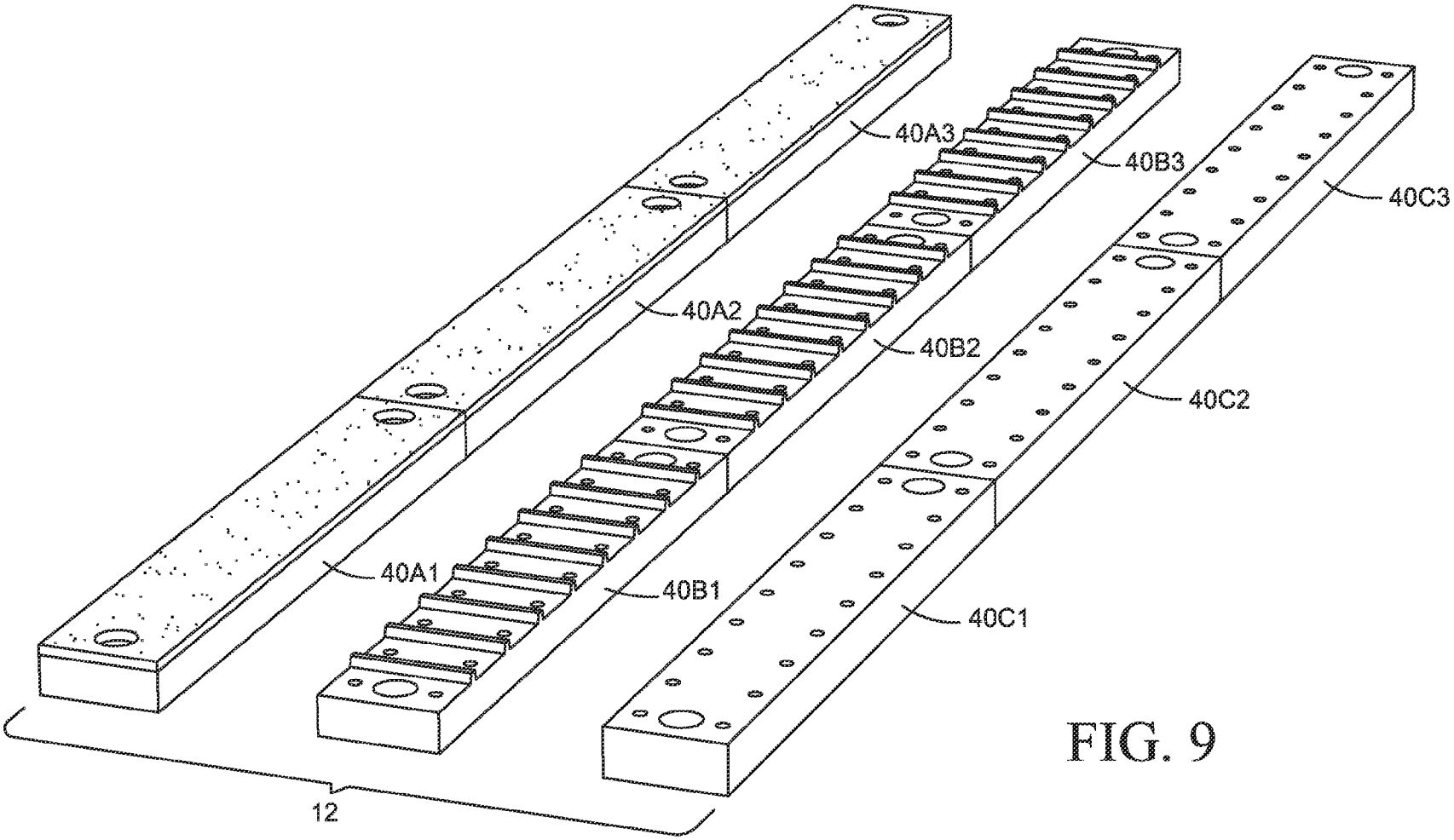
FIG. 9 illustrates the three interchangeable platens of FIGS. 4-6, 7, and 8 together as a group for the platen system implemented in the printer of FIG. 1.

Referring now also to the more detailed views of FIGS. 4-9, platen system 12 includes a group of three interchangeable platens 40—an absorbent platen 40A, for example to support textiles and other porous print substrates (shown individually in FIGS. 4-6), a ridged vacuum platen 40B, for example to support paper and other cockle prone print substrates (shown individually in FIG. 7), and a flat vacuum platen 40C, for example to support vinyl print substrates (shown individually in FIG. 8). The group of interchangeable platens 40A, 40B, and 40C shown in FIGS. 4-9 is just one example group of interchangeable platens for platen system 12. Platen system 12 might include more or fewer interchangeable platens, or differently configured interchangeable platens, than those shown.

In the example shown in FIGS. 4-9, each interchangeable platen 40A-40C is implemented as a series of interchangeable modules: 40A1, 40A2, 40A3; 40B1, 40B2, 40B3; and 40C1, 40C2, 40C3. Modular interchangeable platens 40A-40C help make it easier to vary the width of the platen to accommodate different size print substrates and/or different size printers compared to one-piece platens—the width of the platen may be expanded or contracted simply by using more or fewer modules. Each platen module is fastened to a base 44 with quick release fasteners 42. Platen assembly base 44 is affixed to printer 10 and may be integral to fixed platen 38. Vacuum air passages 36 in base 44 and platens 38, 40 allow pump 34 to apply a vacuum to a print substrate 14 as necessary or desirable to help control the print substrate 14 moving across platen assembly 20. Ridged platen 40B for paper substrates and flat platen 40C for vinyl substrates, for example, usually will include vacuum passages 36 for applying a vacuum to substrate 14, as shown in FIGS. 7 and 8, while absorber platen 40A for textiles usually will not include vacuum passages.

Figure 10:
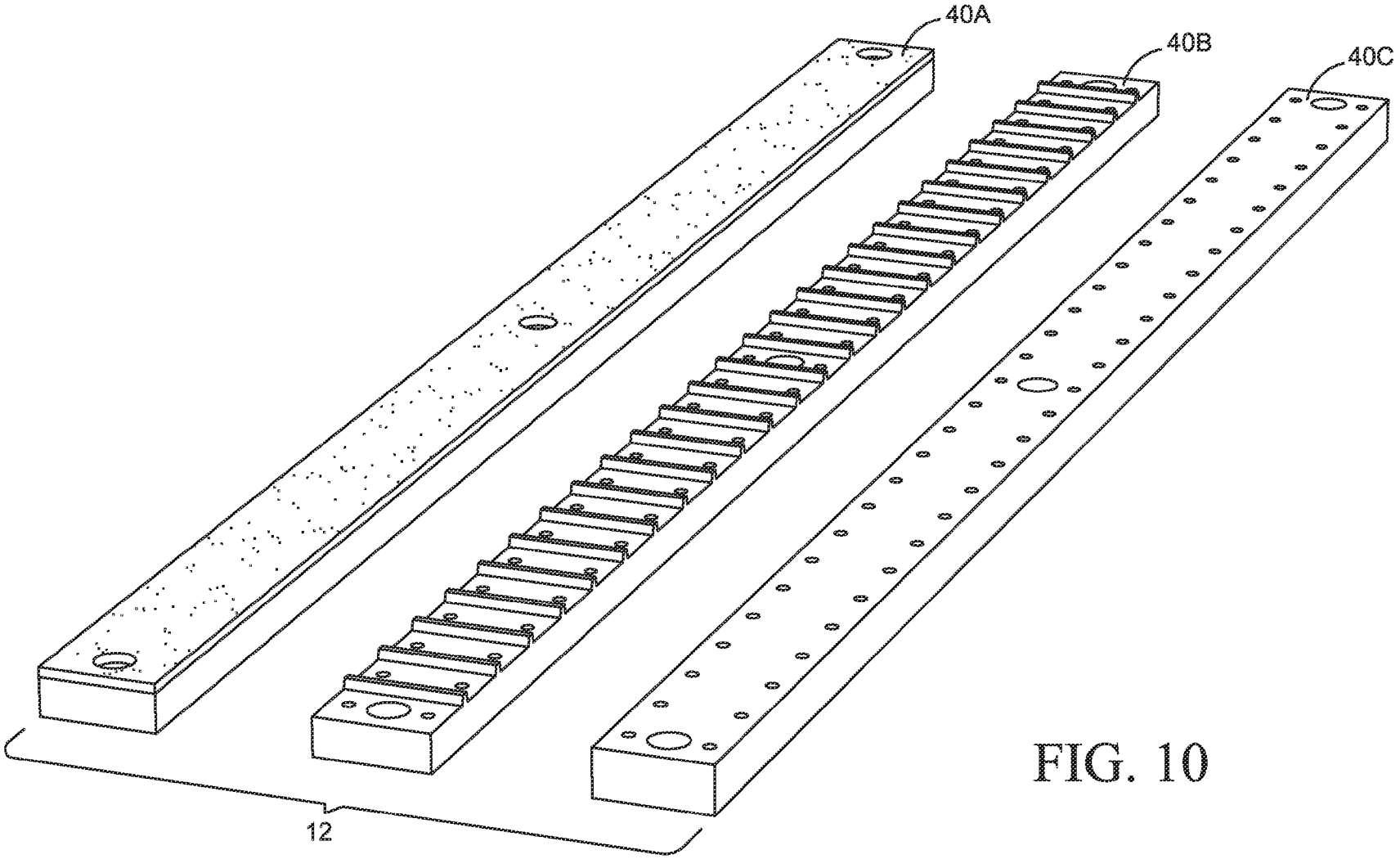
FIG. 10 illustrates another example of the new platen system, in which each of the interchangeable platens is configured as a single module.

FIG. 10 illustrates another example of a platen system 12 in which each of the interchangeable platens 40A, 40B, and 40C is configured as a single component.

Figure 11:
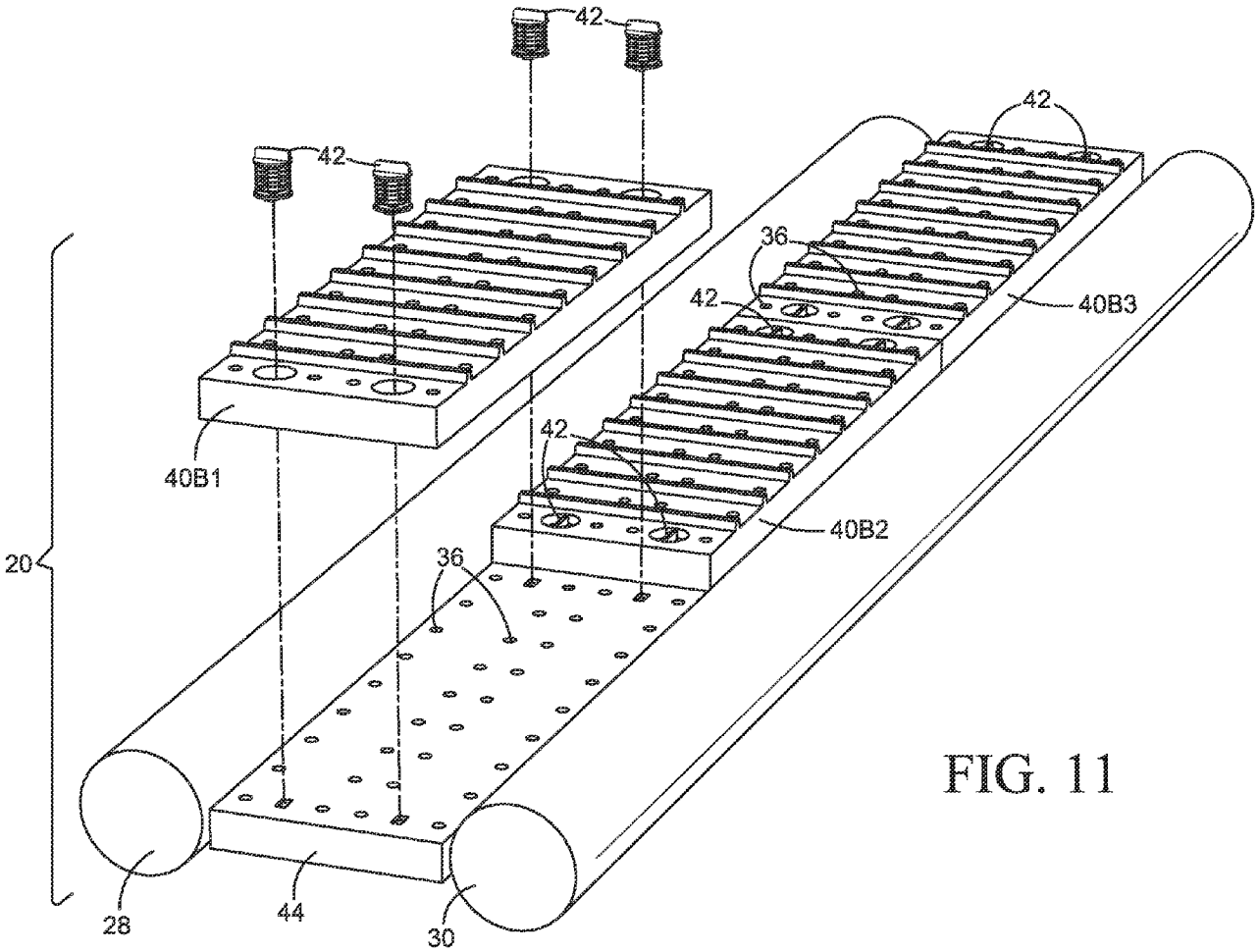
FIG. 11 illustrates another example of the new platen system, in which the entire printer platen is implemented as a removable, interchangeable component.

FIG. 11 illustrates another example of platen system 12 in which platen assembly 20 is configured as a single removable, interchangeable modular platen 40 fastened to base 44. (Instead of a two part assembly with fixed and removable platens.) Interchangeable platen 40 may include, for example, a ridged vacuum platen 40B (shown in FIG. 11) and an absorbent platen 40A and a flat vacuum platen 40C such as those shown in FIG. 10.

Figure 12:
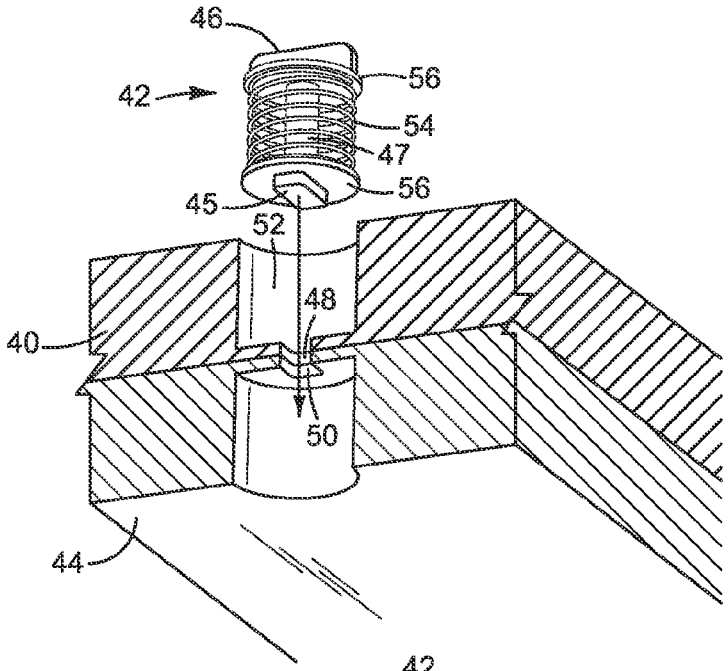
FIGS. 12-14 are detail views illustrating one example of a quick release fastener that may be used to fasten the interchangeable platens in the printer.
Figure 13:
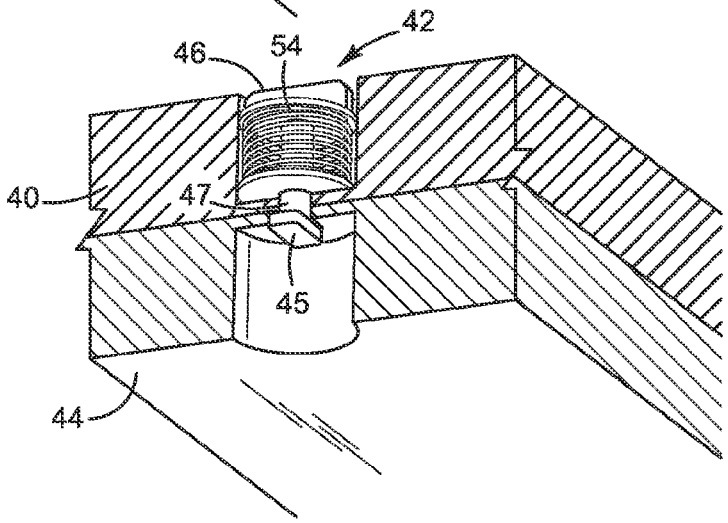
Figure 14:
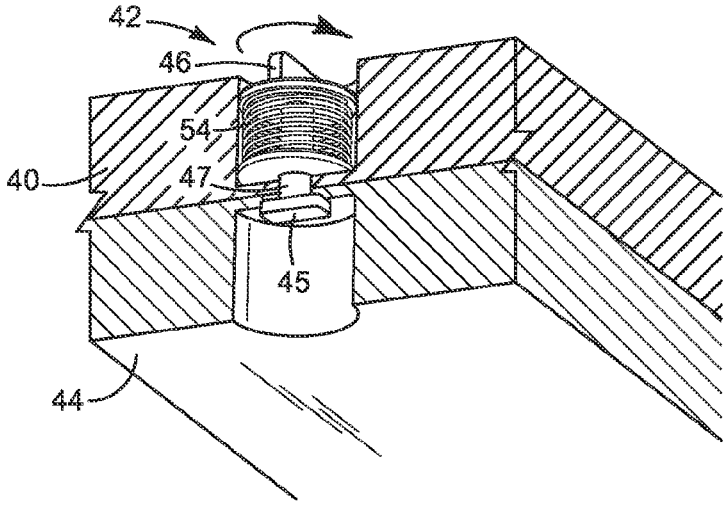

FIGS. 12-14 illustrate the use of one example of a suitable quick release fastener 42 to fasten platens 40A-40C to base 44. Quick release fastener 42 shown in FIGS. 12-14 is commonly referred to as a "quarter turn fastener." The cross-bar 45 of T-shaped retainer 46 is aligned with and inserted through a hole 48 in the bottom of a recess 50 in platen 40 and through a mating hole 52 in base 44 as shown in FIGS. 12 and 13. Then, the stem 47 of retainer 46 is turned to misalign the cross-bar to the holes 50, 52 as shown in FIG. 14. A spring 54 compressed between washers 56 helps secure the platen 40A, 40B, or 40C to base 44. Other suitable manual or automated quick release fasteners may be used.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A platen system for supporting a print substrate during printing on the print substrate by a printer, said system comprising:

a base fixedly positioned in a print zone of the printer, wherein the print zone is an area in the printer at which printing material is applied to the print substrate;

a first platen fixedly attached to the base;

a second platen removably attached to the base, wherein the second platen is to support a predefined type of print substrate;

a first roller positioned adjacent to a first side of the base; and a second roller positioned adjacent to a second side of the base, wherein the first roller and the second roller are to apply tension on the print substrate during printing by the printer on the print substrate.

2. The platen system of claim 1, further comprising a quick release fastener to removably fasten the second platen to the base, and wherein the second platen is positioned immediately adjacent to the first platen.

3. The platen system of claim 1, wherein the second platen is selected from a group of interchangeable platens, wherein each of the interchangeable platens is to support a different type of print substrate, and wherein the group of interchangeable platens includes a platen to support a textile print substrate, a platen to support a paper print substrate, and a platen to support a vinyl print substrate.

4. The platen system of claim 3, wherein the group of interchangeable platens includes a platen with an absorbent material and a platen with ridges.

5. The platen system of claim 3, wherein each of the platens in the group includes multiple platen modules to collectively support the print substrate in the printer.

6. The platen system of claim 5, wherein the platen modules for each platen are interchangeable with one another in the printer.

7. The platen assembly of claim 6, wherein the removable second platen is selected from a group of interchangeable platens, and wherein each of the interchangeable platens in the group of interchangeable platens is to support a different type of print substrate, and wherein the group of interchangeable platens includes a platen to support a textile print substrate, a platen to support a paper print substrate, and a platen to support a vinyl print substrate.

8. A platen assembly for a printer, comprising:

a base fixedly positioned in a print zone of the printer, wherein the print zone is an area in the printer at which printing material is applied to a print substrate;

a fixed first platen fixedly attached to the base; and a removable second platen removably attached to the base, wherein the removable second platen is to support a predefined type of print substrate.

9. The platen assembly of claim 8, wherein the removable second platen is positioned immediately adjacent to the first fixed platen.

10. The platen assembly of claim 8, wherein the removable second platen is fastened to the base with a quick release fastener.

11. The platen assembly of claim 10, wherein the base and the removable second platen include interconnected air passages through which a vacuum is to be applied to the print substrate as the print substrate moves past the removable second platen.

12. An inkjet printer, comprising:

a printhead to dispense ink on to a print substrate in a print zone, wherein the print substrate is of a particular type;

a base fixedly attached to the printer in the print zone;

a first roller positioned adjacent to a first side of the base;

a second roller positioned adjacent to a second side of the base, wherein the first roller and the second roller are to control a direction and tension of the print substrate as the print substrate is moved through the print zone;

a fixed platen fixedly attached to the base; and a removable platen removably attached to the base to support the print substrate in the print zone, wherein the removable platen is to support the particular type of the print substrate.

13. The printer of claim 12, wherein the fixed platen is positioned immediately adjacent to the removable platen.

14. The printer of claim 13, wherein the removable platen is one of a group of interchangeable platens, wherein each of the interchangeable platens is to support a different type of print substrate and wherein each of the platens in the group of interchangeable platens includes multiple platen modules to collectively support the print substrate in the print zone.

15. The printer of claim 14, wherein the removable platen is one from a group of interchangeable platens that includes a platen to support a textile print substrate, a platen to support a paper print substrate, and a platen to support a vinyl print substrate.

* * * * *